US010982577B2

(12) United States Patent
Fenske et al.

(10) Patent No.: US 10,982,577 B2
(45) Date of Patent: Apr. 20, 2021

(54) DEVICE FOR SEPARATING PARTICLES FROM A GAS FLOW, PARTICLE SEPARATOR AND CRANKCASE VENTILATION SYSTEM

(71) Applicant: WOCO Industrietechnik GmbH, Bad Soden-Salmünster (DE)

(72) Inventors: Sebastian Fenske, Gelnhausen (DE); Marcus Rüttger, Steinau an der Straße (DE); Martin Klingelhöfer, Hanau (DE)

(73) Assignee: WOCO Industrietechnik GmbH

( * ) Notice: Subject to any disclaimer, the term of this patent is extended or adjusted under 35 U.S.C. 154(b) by 0 days.

(21) Appl. No.: 16/593,398

(22) Filed: Oct. 4, 2019

(65) Prior Publication Data

US 2020/0109649 A1 Apr. 9, 2020

(30) Foreign Application Priority Data

Oct. 5, 2018 (DE) ..... 102018124652.8

(51) Int. Cl.
*F02B 25/06* (2006.01)
*F01M 13/04* (2006.01)

(52) U.S. Cl.
CPC ..... *F01M 13/04* (2013.01)

(58) Field of Classification Search
CPC .. F01M 13/023; F01M 13/0011; F01M 13/04; F01M 2013/0044; F01M 2013/0066
USPC ..... 123/573
See application file for complete search history.

(56) References Cited

U.S. PATENT DOCUMENTS 4,056,085 A * 11/1977 Nowroski ..... F01M 13/023 123/574
9,670,806 B2 * 6/2017 Eckard ..... F01M 13/0011
2003/0075046 A1 * 4/2003 Lenzing ..... B01D 45/06 95/267
2009/0199826 A1 8/2009 Meinig et al.
(Continued)

FOREIGN PATENT DOCUMENTS

DE 10 2004 049 089 A1 4/2006
DE 20 2005 009 990 U1 11/2006
(Continued)

OTHER PUBLICATIONS

Office Action dated Sep. 25, 2019 for German Patent Application No. 10 2018 124 647.1 (German language only) (14 pp.).

*Primary Examiner* — Long T Tran
*Assistant Examiner* — James J Kim
(74) *Attorney, Agent, or Firm* — Brinks Gilson & Lione

(57) ABSTRACT

A device separates particles such as oil particles from a gas flow, from a blow-by gas of a crankcase ventilation, in an internal combustion engine. The device includes a valve seat that defines a flow passage opening and a movable valve element that can be displaced between a closed position, in which the valve element is in abutting contact with the valve seat and the abutting contact defines an axial abutting point, and at least one open position, in which the valve element is moved from the axial abutting point in an axial actuating direction. The movable valve element has a rotationally symmetrical bowl upstream of the gas flow, and a base of the bowl axially protrudes past the abutting point opposite to the axial actuating direction.

16 Claims, 6 Drawing Sheets

(56) References Cited

U.S. PATENT DOCUMENTS

| | | | | |
|---|---|---|---|---|
| 2010/0101425 | A1* | 4/2010 | Herman | B01D 45/08 96/400 |
| 2016/0138442 | A1* | 5/2016 | An | F01M 13/021 123/559.1 |
| 2017/0314432 | A1* | 11/2017 | Dwivedi | F01M 13/023 |

FOREIGN PATENT DOCUMENTS

| | | | |
|---|---|---|---|
| DE | 10 2008 044 857 | A1 | 8/2010 |
| DE | 20 2010 001 191 | U1 | 6/2011 |
| DE | 10 2010 029 322 | A1 | 12/2011 |
| DE | 20 2016 104 363 | U1 | 12/2017 |
| DE | 10 2017 119 833 | A1 | 2/2019 |
| WO | WO 2011/089006 | A1 | 7/2011 |
| WO | WO 2016/184768 | A1 | 11/2016 |

* cited by examiner

DEVICE FOR SEPARATING PARTICLES FROM A GAS FLOW, PARTICLE SEPARATOR AND CRANKCASE VENTILATION SYSTEM

RELATED APPLICATION

This application claims the benefit and priority of German Patent Application DE 10 2018 124 652.8, filed Oct. 5, 2018, which is incorporated by reference herein in its entirety.

TECHNICAL FIELD

The present invention relates to a device for separating particles, such as oil particles, from a gas flow, such as from a blow-by gas of a crankcase ventilation, in an internal combustion engine. The embodiments further relate to a particle separator or to a crankcase ventilation system.

BACKGROUND

Separators, particularly oil separators, are generally known from the prior art. There generally exist two types of separators, namely active separators and passive separators. Active separators are characterized in that additional energy is expended for acting upon the particles, particularly oil particles, in order to achieve an increased separation efficiency. In a known electric separation system, for example, particles are electrically charged such that they are attracted by an antipolar surface and subsequently can be separated. In passive separators, no additional energy is introduced into the system. For example, passive separators utilize the kinetic energy of the gas flow. In this case, the particles are conveyed, for example, through a labyrinth or a cyclone such that they can be separated from the gas flow due to their mass inertia, wherein the particles can thereby be removed from the gas flow, which is subsequently cleaned. In oil separators, the oil particles particularly are returned into the oil circuit and the cleaned gas flow is returned into the intake air of the internal combustion engine.

An oil separating device is disclosed, for example, in DE 10 2008 044 857. In this case, the gas flow is directed against a deflection regulator that is pretensioned by a spring on a housing of the separator. The deflection regulator is surrounded by an impact surface. The volume flow presses the deflection regulator against the spring force of the pressure spring such that an annular gap is formed between the deflection regulator and the impact surface, wherein the volume flow can flow through this annular gap in order to thereby realize an oil separating function. In this constructive design, however, it proved disadvantageous that the available spring travel is limited without significantly increasing the overall axial dimension of the oil separator. Due to the limited spring travel, the response characteristic and basically the adjustment of the oil separation valve can only be realized to a certain extent.

SUMMARY

The present invention is therefore based on the objective of rectifying the disadvantages of the prior art, particularly by making available a device for separating particles from a gas flow, a particle separator and a crankcase ventilation system, in which the response characteristic and the adjustability, especially a precision adjustment, with respect to the gas through-flow can be optimized, particularly without increasing the axial dimension of the device, the particle separator and the crankcase ventilation system.

According to one embodiment, a device for separating particles such as oil particles from a gas flow, such as from a blow-by gas of a crankcase ventilation, in an internal combustion engine comprises a valve seat that defines a flow passage opening and a movable valve element that can be displaced between a closed position, in which the valve element is in abutting contact with the valve seat and the abutting contact defines an axial abutting point, and at least one open position, in which the valve element is moved from the axial abutting point in an axial actuating direction. The inventive device for separating particles is also referred as separating device below. The axial direction extending opposite to the actuating direction is referred to as closing direction, whereas directions oriented perpendicular to the actuating direction are referred to as radial direction.

In one field of application, namely in a crankcase ventilation of an internal combustion engine, the gas flow may comprise, among other things, oxygen, other air components, unburnt fuels, combustion gases and oil. The particles to be separated are oil particles, which particularly are returned to a point of destination such as a crankcase via a return pipe. Depending on the respective field of application, the present embodiments also makes it possible to separate other particles in different states of aggregation. In the context of the present embodiments, particles may have a solid or liquid state of aggregation and not only consist of oil, but also of other materials such as water or soot particles. Furthermore, the field of application is not necessarily limited to internal combustion engines. The separating device can also be used, for example, for the water separation in fuel cell systems.

The valve seat particularly defines a flow passage opening, by means of which the separating device is fluidically connected to a gas flow source such as a crankcase. It should be clear that the term gas flow source merely refers to the gas flow flowing from the corresponding component toward the separating device, but not necessarily being formed in the gas flow source.

In the closed position, the gas flow is not necessarily interrupted by the separating device in the closed position. A fluid passage in the closed position may be allowed as described further below by contouring an abutting contact surface of the valve element and/or the valve seat and/or by providing leakage elements such as leakage projections or leakage depressions in the valve element and/or the valve seat. The closed position and the open position particularly are distinguished in that a passage opening between the valve element and the valve seat, through which the gas flow exits a flow space between the valve seat and the valve element downstream, is larger in the open position than in the closed position. The passage opening for the gas flow particularly can be variably adjusted between the open position and the closed position. The passage opening, through which the gas flow exits the flow space between the valve seat and the valve element downstream, particularly is formed between an abutting contact surface of the valve seat and an abutting contact surface of the valve element during the displacement of the valve element from the closed position into an open position. The flow passage opening extends rotationally symmetrical, particularly annularly, about a rotational axis or a rotational axis of symmetry, in the circumferential direction and in the actuating direction. The axial extent of the particularly cylindrical passage opening corresponds to the displacement of the valve element from the closed position in the actuating direction.

The flow space between the valve element and the valve seat particularly is realized in the form of a gap, such as in the form of a collar-shaped gap, especially in the form of a rotationally symmetrical collar-shaped gap. During the flow through the flow space between the valve seat and the valve element, particles are separated on the space-defining flow guide surfaces of the valve seat and/or the valve element. The flow space can be enlarged by displacing the actuating element in the actuating direction, wherein particularly the distance between the flow guide surfaces increases at least partially during a displacement of the valve element in the actuating direction.

According to a embodiment, the valve element has a rotationally symmetrical bowl upstream of the gas flow. The rotationally symmetrical bowl particularly comprises a bowl base that defines the bowl in the closing direction, as well as a shell that defines the bowl in the radial direction. The bowl is open in the actuating direction. The bowl particularly encloses a space that is open in the actuating direction. The space may assume different shapes. For example, it may be realized in the shape of a funnel, a cylinder, a pyramid or a combination of these shapes. The space enclosed by the bowl is on its axial end in the closing direction defined by a radially extending surface of the bowl, particularly a disk-shaped surface of the bowl base.

According to one embodiment, the bowl base axially protrudes past the abutting point opposite to the axial actuating direction by at least 5 mm, particularly by at least 10 mm, such as by at least 10%, 20%, 30%, 40% or 50% of the longitudinal extent of the valve element. In this context, the term bowl base particularly refers to the surface of the bowl that defines the bowl in the closing direction and faces the actuating direction. The axial end of the valve seat, particularly the hollow body, especially the funnel-shaped section of the valve seat, axially protrudes past the abutting point opposite to the axial actuating direction, such as by at least 10 mm, such as by at least 10%, 20%, 30%, 40% or 50% of the longitudinal extent of the valve element. The axial end of the valve element in the closing direction is formed by the bowl. The flow passage opening is alternatively or additionally formed on the axial end of the valve seat in the closing direction. The flow passage opening particularly is defined by a rotationally symmetrical section of the valve seat that is tapered in the closing direction. The flow passage opening is spaced apart from the abutting point in the closing direction, particularly by at least 10 mm, such as by at least 10%, 20%, 30%, 40% or 50% of the longitudinal extent of the valve element.

In an exemplary embodiment, a spring that causes a displacement into the closed position is supported on the bowl base. The spring is pretensioned between the bowl base and a wall that is spaced apart from the bowl base in the actuating direction and lies opposite of the valve seat. The spring particularly is pretensioned in such a way that it exerts a closing force upon the valve element in the closed position and the valve element cannot be moved in the actuating direction until the closing force has been overcome. The bowl base particularly is realized in a disk-shaped manner and/or the bowl has a shell that extends from the bowl base in the actuating direction. The bowl alternatively or additionally comprises a guide pin, which particularly extends centrally from the bowl base in the actuating direction, in order to guide the spring and/or the valve element. The spring is placed over the guide pin such that it is guided by the guide pin in the actuating direction and in the closing direction. In the context of the present embodiments, the term guidance particularly refers to the motion of the guided part at least being limited in at least one direction other than the guided direction and/or to centering of the part taking place along a rotational axis of symmetry of the guiding part or the guided part.

The guidance of the valve element by the guide pin can be ensured, for example, in that the guide pin extends through a passage opening of the housing, on which the spring is supported in the actuating direction, such that particularly a relative motion of the valve element in a direction other than the actuating direction or closing direction is at least limited by the radial boundary of the passage opening. An annular space, which becomes larger in the actuating direction, particularly is formed between the guide pin and the shell. The outer circumference of the annular space particularly is defined by the shell of the bowl and its inner circumference is defined by the guide pin. Furthermore, the annular space is defined by the bowl base in the closing direction and open in the actuating direction. The bowl base serves as a supporting point for the spring such that particularly the radial surface of the bowl base, which extends between the shell and the guide pin and is oriented in the actuating direction, is realized in the form of an annular surface, the outside diameter of which at least corresponds to the outside diameter of the spring, particularly coil spring, to be used. The annular space particularly serves for accommodating the spring.

In one embodiment, the valve seat forms a rotationally symmetrical hollow body, which particularly is shaped complementary to the bowl. The hollow body particularly is tapered in a closing direction extending opposite to the actuating direction, wherein the bowl particularly can be telescopically displaced into the actuating position and the closed position inside the hollow body. Alternatively or additionally, the hollow body guides the valve element during a displacement in the actuating direction and the closing direction and/or the hollow body defines the flow passage opening. The hollow body and/or the shell of the bowl initially extends in the closing direction in an essentially cylindrical manner and is then tapered in the radial direction, particularly in the shape of a funnel. The radially outer surfaces of the bowl, particularly the shell, and the radially inner surfaces of the valve element, particularly the hollow body, especially form flow guide surfaces, along which the particle-laden gas flow flows between the valve element and the valve seat. The cylindrical section and/or the tapered section of the hollow body and the shell are shaped complementary to one another in such a way that a gap with essentially constant gap width is formed between the shell and the hollow body in the closed position. The gap between the shell and the hollow body initially extends in the closing direction in an essentially cylindrical manner and is then tapered in the radial direction, particularly in the shape of a funnel. The gap width between the shell and the hollow body particularly is increased by displacing the valve element in the actuating direction. During a displacement of the valve element in the actuating direction and in the closing direction, this valve element particularly is displaced into and out of the hollow body in a telescopic manner. Depending on the respective embodiment, the gap width in the closed position can be increased or decreased. The flow resistance to the gas through-flow increases as the gap width decreases and vice versa. A reduction of the gap width particularly makes it possible to enhance the guiding function of the valve seat relative to the valve element.

In an embodiment, the gap width between the hollow body and the shell is minimized, particularly eliminated. In this case, at least one guide projection and/or one guide depression is arranged on the shell of the bowl and/or on the hollow body of the valve seat in order to produce a physical contact between the shell and the hollow body in the closed state on the one hand or to at least significantly reduce the gap width and simultaneously ensure a through-flow along the flow guide surfaces.

In another embodiment, the valve element has a collar that leads into the bowl and defines an annular space, which is open in a closing direction extending opposite to the actuating direction, together with the bowl. The valve element collar particularly leads into the axial end of the bowl in the actuating direction. The valve element collar comprises an essentially annular section, which particularly extends radially from the axial end of the bowl in the actuating direction. Furthermore, the valve element collar particularly comprises a hollow cylinder that essentially extends in the closing direction, wherein said hollow cylinder particularly extends radially from the outer side of the annular section in the closing direction. The cylindrical section of the valve element collar extends essentially parallel to the bowl, particularly to the shell of the bowl. The cylindrical section of the valve element collar and the bowl particularly form an annular space, which is defined by the annular section of the valve element collar in the actuating direction and open in the closing direction.

In another embodiment, the valve seat has a collar that particularly leads into the hollow body and especially protrudes into the annular space between the bowl and the valve element collar, wherein the valve seat collar defines an annular space that is open in the closing direction and particularly defines an annular space that is open in the closing direction together with the hollow body of the valve seat. The valve seat collar leads into the end of the hollow body of the valve seat, particularly the cylindrical section of the valve seat, in the actuating direction. The valve seat collar comprises an annular section, which particularly is curved in a concave manner in the actuating direction and extends radially from the end of the valve seat, particularly the hollow body, in the actuating direction. Furthermore, the valve seat collar particularly comprises a cylindrical section that essentially extends in the closing direction, especially from the end of the annular section of the valve seat collar in the radial direction. The cylindrical section of the valve seat collar and the hollow body of the valve seat define an annular space, which is open in the closing direction, in the radial direction, wherein the annular section of the valve seat collar particularly defines the annular space in the actuating direction. The valve element, especially the bowl and the valve element collar, respectively encompasses or overlaps the valve seat, especially the hollow body and the collar of the valve seat, in the closed position.

In another embodiment, the axial abutting point is formed by a radial web, which extends in a radial direction that is oriented perpendicular to the actuating direction and particularly leads into the valve seat collar, wherein the valve seat collar, the radial web and an axial web extending from the radial web in the actuating direction particularly define an annular gap that is open in the actuating direction, and wherein the annular gap particularly guides the valve element during a displacement in the actuating direction and in the closing direction. The radial web is realized annularly, wherein the radial web and the valve element essentially have an identical rotational axis of symmetry. The inside diameter of the radial web is slightly smaller than the inside diameter of the cylindrical section of the valve element collar and/or that the outside diameter of the radial web is slightly larger than the outside diameter of the cylindrical section of the valve element collar. The term slightly larger particularly refers to at least 1 mm, 2 mm, 3 mm, 5 mm or 10 mm and/or no more than 10 mm, 15 mm, 20 mm or 30 mm. The surface of the radial web, which is oriented in the actuating direction, forms the abutting contact surface of the valve seat and/or that the end of the cylindrical section of the valve element collar in the closing direction forms the abutting contact surface of the valve element. In the closed position, the abutting point particularly is formed between the abutting contact surface of the valve element and the abutting contact surface of the valve seat. The annular gap between the valve seat collar, the radial web and the axial web, which is open in the actuating direction, and may widen in the actuating direction such that the risk of tilting the valve element is reduced, particularly during the displacement of the valve element from an open position into the closed position, and/or the valve element is centered relative to a rotational axis of symmetry of the valve element or the valve seat during the continued displacement into the closed position.

In another embodiment, at least one leakage opening is arranged in the valve element, such as in the bowl, particularly in the bowl base, wherein said leakage opening allows a fluid return such as a drainage, particularly of separated particles, opposite to the actuating direction and/or a fluid passage in the closed position. Due to the bowl-shaped design of the valve element, in particular, the arrangement of at least one leakage opening in the bowl base has the advantage that the radially inner wall of the bowl acts as a flow guide surface for gas flows, which reach the bowl through the leakage opening. In an embodiment with a guide pin, which particularly extends from the bowl base in the actuating direction, the guide pin makes available additional flow guide surfaces for the separation of particles. Furthermore, the arrangement of at least one leakage opening in the bowl, particularly in the bowl base, has the advantage that the bowl shape causes separated particles to at least partially flow in the direction of the bowl base, from where they can be discharged through the at least one leakage opening.

According to another embodiment, which can be combined with the preceding embodiments, the separating device comprises a spring, such as a coil spring, which is supported on the valve element and causes a displacement of the valve element into the closed position. The point, at which the spring is supported on the valve element, is referred to as supporting point below. The displacement of the valve element into the closed position particularly can be realized by pretensioning the spring between the valve element and a housing wall such as the housing wall of a cover, which lies opposite of the supporting point on the valve element. The thusly generated pretensioning force particularly holds the valve element in the closed position until the fluid pressure of the gas flow suffices for overcoming the pretensioning force. According to another embodiment, the supporting point of the spring axially protrudes past the abutting point opposite to the axial actuating direction in the closed position of the valve element. In contrast to conventional valve elements, in which the supporting point of the spring protrudes past the abutting point in the actuating direction, the axial extent of the structural space required for the spring can thereby be reduced in the actuating direction. The axial end of the valve seat, particularly the hollow body, especially the funnel-shaped section of the valve seat, axially protrudes past the abutting point opposite to the axial actuating direction, particularly by at least 10 mm, such as by at least 10%, 20%, 30%, 40% or 50% of the longitudinal extent of the valve element. The flow passage opening is alternatively or additionally formed on the axial end of the valve seat in the closing direction. The flow passage opening particularly is defined by a preferably rotationally symmetrical section of the valve seat, which is tapered in the closing direction. It is particularly preferred that the flow passage opening is spaced apart from the abutting point in the closing direction, particularly by at least 10 mm, such as by at least 10%, 20%, 30%, 40% or 50% of the longitudinal extent of the valve element.

The embodiments and characteristics described in connection with other aspects or other embodiments can be combined with embodiments and characteristics of the embodiments already described and vice versa.

In another embodiment, the valve element has a guide pin, which extends from the supporting point in the actuating direction and over which the spring is placed, wherein the guide pin particularly moves out of a housing that defines the device during the displacement of the valve element in the actuating direction whereas the spring is supported on the housing, particularly on a housing wall lying opposite of the supporting point, and wherein a passage opening for the guide pin in the housing particularly is dimensioned in such a way that it guides the valve element, particularly the guide pin, during a displacement in the actuating direction and in the closing direction. The guide pin extends along an axis of symmetry of the valve element, particularly a rotational axis of symmetry. The term placement particularly refers to the spring, particularly windings of a coil spring, extending around the guide pin and/or extending coaxial to the guide pin in the actuating direction. The guide pin particularly extends from the supporting point in the actuating direction only, i.e. not in the closing direction. The end of the guide pin in the actuating direction, which faces away from the supporting point, and protrudes into the passage opening of the housing. The axial end of the guide pin in the actuating direction protrudes out of the housing through the passage opening. The spring particularly is supported on the housing section surrounding the passage opening. The spring is compressed, particularly between the supporting point on the valve element and the supporting point on the housing, during a displacement of the valve element in the actuating direction.

In another embodiment, the spring has a progressive spring characteristic and particularly is a progressively coiled spring. Another spring is alternatively or additionally arranged in series with this spring, wherein the upstream spring near the valve element particularly has a lower spring constant than the downstream spring, and wherein the spring near the valve element particularly is supported on the valve element and the downstream spring is supported on the spring near the valve element. The spring characteristic particularly influences the valve element position being adjusted at a certain fluid pressure. The term progressive spring characteristic particularly refers to the spring constant not being constant during a compression or expansion between the closed position and the maximal open position. For example, the spring constant of the spring may be constant up to a certain compression and then abruptly increase or decrease such that the spring has a correspondingly higher or lower constant spring constant during its further compression. Alternatively or additionally, the spring constant may increase linearly or exponentially with the compression of the spring. In addition to the use of progressively coiled springs and the serial arrangement of springs, it would also be possible to arrange multiple springs in parallel. However, it proved advantageous to use a spring with progressively coiled spring core and/or a serial arrangement of springs with different spring constants and to place the spring or springs over the guide pin because an additional space requirement in the radial direction for multiple springs arranged in parallel can thereby be prevented. With respect to the progressive spring characteristic, it proved advantageous to choose the progression in such a way that the spring constant increases as the valve element is displaced in the actuating direction. In this way, it can particularly be ensured that the valve element is also displaced into an open position at a low fluid pressure of the gas flow, but the maximal open position is only reached at high fluid pressures. In comparison with a spring that has a constant spring characteristic and, in particular, the same overall axial extent, the response characteristic of the valve element can thereby be adapted, particularly optimized, over a greater fluid pressure range of the gas flow.

In another embodiment, the device comprises a multipart housing, wherein the housing particularly has an inflow housing part that contains the flow passage opening and a cover part that can be connected to the inflow housing part, and wherein the valve element and the spring are supported in the housing and/or wherein the housing parts are connected to one another by means of a clip connection and/or wherein the housing, particularly the inflow housing part, can be connected to the crankcase by means of a tongue-and-groove connection. The inflow housing part and the valve seat are realized integrally.

The housing particularly defines a separation space, wherein the gas flow particularly flows into this separation space through the flow passage opening and out of said separation space through separating nozzles. Some embodiments of these separating nozzles are described further below. The separation space particularly comprises a flow space between the valve seat and the inflow housing part, particularly the valve element, and/or a bypass space between the valve element and the cover part. The flow space and the bypass space are connected by at least one leakage opening in the valve element, by contouring an abutting contact point of the valve seat and/or valve element, particularly the abutting point, and/or by the passage opening between the valve seat and the valve element in an open position.

The inflow housing part is designed for being fastened on a gas flow source with a gas outlet opening, particularly on a crankcase. The gas flows from the gas outlet opening of the gas flow source into the flow passage opening of the valve seat, which particularly is realized integrally with the inflow housing part. The inflow housing part comprises an annular recess, particularly an annular space, which extends in the actuating direction, especially radially outside the flow passage opening, wherein said annular space particularly is closed in the actuating direction and open in the closing direction. The annular space, which is open in the closing direction, particularly protrudes beyond the abutting point in the actuating direction.

The cover part particularly comprises the passage opening for the guide pin and/or the supporting point for the spring on the housing side. At least one emergency ventilation opening, especially just one emergency ventilation opening, particularly may be provided in the cover part. Gas flows particularly can be discharged from the separating device and/or from a gas flow source such as a crankcase through the emergency ventilation opening in case of a blockage of the valve element and/or the valve seat, e.g. due to icing, such that especially the ventilation function of the separating device is preserved. The emergency ventilation opening particularly makes it possible to bypass the flow space and/or the bypass space and to discharge the gas flow past the valve element and/or the valve seat through the emergency ventilation opening. In this case, the gas flow enters the housing through the inflow housing part and exits the housing through the emergency ventilation opening, wherein the entry into the inflow housing part particularly takes place via a bypass, and wherein the gas flow particularly does not pass the flow passage opening of the valve seat. The emergency ventilation opening in the cover part extends radially inward and/or outward beyond the radial web and/or beyond the abutting point. With respect to the circumferential direction, the emergency ventilation opening particularly extends about the rotational axis of symmetry of the valve element and/or the valve seat over 10° to 150°, such as over 20° to 120°, especially over 30° to 90°. The radial web particularly is interrupted at the circumferential position of the emergency ventilation opening, especially by providing a bypass passage opening in the housing inflow part, in order to thereby form a bypass for the gas flow in the housing inflow part. The emergency ventilation opening is realized in the form of annular sections or angularly, particularly quadrangular.

In another exemplary embodiment, the valve element has a rotationally symmetrical bowl upstream of the gas flow, wherein the supporting point for the spring is formed on the bowl base of said bowl. At this point, it should once again be clarified that embodiments and characteristics of the initially described embodiments can be combined with the other described embodiments and vice versa, particularly by respectively supporting the spring on the bowl base of the valve element or by designing the valve element with a bowl base, on which the spring is supported.

In another embodiment, the valve seat and the valve element are realized in a collar-shaped manner and particularly can be telescopically displaced inside one another in such a way that a continuous collar-shaped gap is formed in the circumferential direction between the valve element and the valve seat in the open position and/or in the closed position. The valve seat and the valve element respectively have a collar that particularly leads into the respective axial end in the actuating direction of a cylindrical hollow body of the valve element or the valve seat. The respective collars particularly extend radially outward from the cylindrical hollow bodies and in the closing direction. The valve element collar and the bowl of the valve element define an annular space, which is open in the closing direction and into which the valve seat collar protrudes in the closed position. The collar-shaped gap between the valve element and the valve seat borders on an axial end of a hollow-cylindrical gap in the actuating direction and extends radially outward from this location and in the closing direction. The hollow-cylindrical gap initially extends, in particular, in an essentially hollow-cylindrical manner in the closing direction and then in a funnel-shaped manner, such that it is tapered in the closing direction, in order to ultimately transform into the flow passage opening. The gap, particularly the collar-shaped gap, is formed between sections of the valve seat and the valve element collar that are realized complementary to one another. The gap between the valve element and the valve seat increases during a displacement of the valve element in the actuating direction A, wherein the extent of the collar-shaped gap particularly increases in the actuating direction.

In an exemplary enhancement of the inventive separating device, at least one separating nozzle, which has a constant through-flow cross section, is arranged downstream of the valve element for the nebulization and/or defined discharge of the gas flow. The separating nozzle may form at least one gap in the separation space or be realized in the form of such a gap. The separating nozzle may be realized in the form of a so-called static nozzle, wherein particularly the gap cross section and therefore the through-flow cross section of the separating nozzle essentially are constant regardless of the position of the valve element. The separating nozzle is arranged downstream of the abutting contact between the valve element and the valve seat. For example, the separating nozzle may be realized by a housing part that lies opposite of the valve seat, e.g. a cover, and by the valve seat. The housing part and the valve seat may be adapted to one another with respect to their shape and/or arranged relative to one another in such a way that an essentially constant gap, by means of which a particle separation is realized, is in the installed state of the separating nozzle formed downstream of the abutting contact between the housing part and the valve seat during the operation. In an open position, for example, a flow cross section between the valve element and the valve seat at the abutting point lies in the range between 90% and 200%, such as in the range between 100% and 180%, particularly in the range between 120% and 170%, of a through-flow cross section of the separating nozzle, wherein 100% refers to identical cross-sectional areas. A clear flow cross section, which defines a radially oriented clear cross-sectional area, exists between the valve seat and the valve element in an open position, wherein this clear cross-sectional area particularly changes along the flow direction, i.e. in the axial direction, and the gas flow reaches the separation chamber through said clear cross-sectional area past the valve seat and the valve element, particularly through the flow passage opening of the valve seat. The gas flow can be accelerated along a pressure gradient between the separating nozzle inlet opening and the separating nozzle outlet opening in order to thereby improve the separating efficiency of the inventive separating device.

According to another embodiment, which can be combined with the preceding embodiments, a particle separator is made available. The inventive particle separator comprises at least two devices for separating particles such as oil particles from a gas flow, from a blow-by gas of a crankcase ventilation, in an internal combustion engine. In this case, the at least two separating devices particularly are realized in accordance with the separating devices described with reference to the preceding embodiments.

The at least two devices respectively comprise a valve seat that defines a flow passage opening and a movable valve element. The valve element can be displaced between a closed position, in which the valve element is in abutting contact with the valve seat and the abutting contact may define an axial abutting point, and at least one open position, in which the valve element is moved from the axial abutting point in an axial actuating direction.

The at least two devices particularly are fluidically connected to one another in such a way that a gas flow can be divided between the two devices upstream of the particle separator and/or a gas flow can flow from one device into the other device. For example, the at least two devices may be arranged parallel to one another, wherein parallel should be interpreted in such a way that a gas flow impinging upon the particle separator can flow into both of the at least two devices, for example divided between the two devices. The inventive arrangement of the at least two devices, particularly in an inventive particle separator, makes it possible to significantly increase the separation rate. Since the gas flow exiting one device can after the particle separation in this device flow into the other of the at least two devices for another particle separation, the resulting gas flow is significantly cleaner and can subsequently be returned, for example, to the fresh air supply of the internal combustion engine.

With respect to other exemplary embodiments of the separating devices, we refer to the preceding embodiments, which may likewise apply in this context.

According to another embodiment, a crankcase ventilation system of an internal combustion engine is made available. Generic crankcase ventilation systems typically serve for preventing a pressure increase within the crankcase, which particularly results from blow-by gases from the combustion cycle of the internal combustion engine. The crankcase ventilation system comprises a crankcase with a flow outlet opening, through which the blow-by gas can exit the crankcase. For example, a pipeline system may be connected to the flow outlet opening of the crankcase. According to one embodiment, the crankcase ventilation system comprises a device that is fluidically connected to the flow outlet opening and serves for separating particles such as oil particles from the blow-by gas, wherein the separating device is realized in accordance with one of the preceding embodiments.

BRIEF DESCRIPTION OF THE DRAWINGS

Other properties, advantages and characteristics of embodiments of the invention are described below with reference to the attached drawings, in which.

DETAILED DESCRIPTION

In the following description of exemplary embodiments, an inventive device for separating particles is also simply referred to as separating device and generally identified by the reference symbol 51. The separating device as a whole is described in detail with reference to FIGS. 11 and 12, which show an inventive particle separator that is generally identified by the reference symbol 53.

Figure 1:
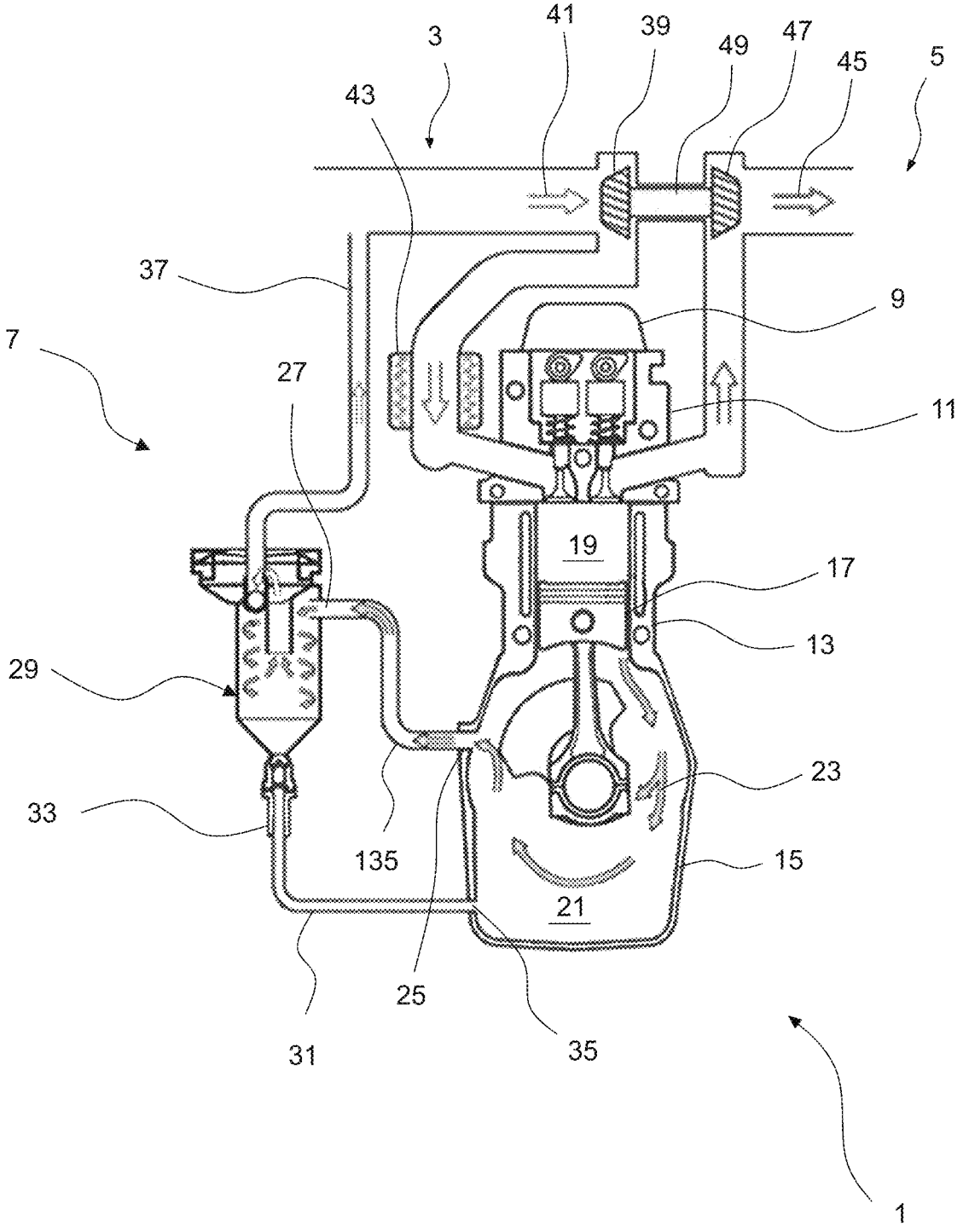
FIG. 1 shows an inventive crankcase ventilation system in the form of a schematic diagram of an example of the formation of blow-by gases and of the installation position of inventive separating devices and particle separators.

FIG. 1 shows an embodiment of an inventive crankcase ventilation system of an internal combustion engine, which is identified by the reference symbol 29 below. The crankcase ventilation system 29 comprises a crankcase 15 with a flow outlet opening 25, through which blow-by gas can exit the crankcase 15, and an inventive separating device 51 that is fluidically connected to the flow outlet opening 25 and schematically indicated in FIG. 1. It should be clear that an inventive particle separator 53 may also be fluidically coupled to the outlet opening instead of the inventive separating device 51 in order to form an inventive crankcase ventilation system 29. According to FIG. 1, the fluidic connection between the separating device 51 and the flow outlet opening 25 may be realized by means of a pipeline system such as an outlet pipe 135, which fluidically connects the flow outlet opening 25 of the crankcase to the flow passage opening 27 of the separating device 51. In a (not-shown) alternative embodiment, the separating device 51 may be mounted on the crankcase 15 in such a way that the flow passage opening 27 of the separating device 51 corresponds to the flow outlet opening 25 of the crankcase 15.

FIG. 1 furthermore shows an example of the formation of blow-by gas and of the general installation position of separating devices 51 and particle separators 53. This figure shows an internal combustion engine 1 that is fluidically coupled to a fresh air supply 3, an exhaust gas discharge 5 and a crankcase ventilation 7. The internal combustion engine 1 comprises a cylinder head cover 9, a cylinder head 11, a cylinder 13 and a crankcase 15. A piston 17 is guided in the cylinder and separates a swept volume 19 from a crankcase interior 21. Not-shown sealing rings are provided between the piston 17 and the cylinder 13 in order to seal the swept volume 19 relative to the crankcase interior 21. Nevertheless, combustion gases and/or unburnt gases flow from the swept volume 19 into the crankcase interior 21 between the piston 17 and the cylinder 13. The resulting gas flow 23 is also referred to as blow-by gas flow and not only contains air and oil, but also combustion gases and unburnt fuel components.

In order to prevent a pressure increase in the crankcase 15, the gas flow 23 is discharged from the crankcase 15 by means of a crankcase ventilation 7 and fed to the fresh air supply 3. In this case, the crankcase ventilation 7 particularly comprises the fluidic coupling between the flow outlet opening 25 of the crankcase 15 and the flow passage opening 27 of the separating device 51. The separating device 29 furthermore is fluidically connected to the crankcase 15 by means of a return pipe 31 for returning separated particles such as oil. The return pipe 31 fluidically connects, in particular, a return outlet 33 of the separating device 29 to a return inlet 35 on the crankcase 15. Furthermore, a return pipe 37 fluidically connects the separating device 51 to the fresh air supply 3 upstream of the separating device 29 in order to feed a gas flow, from which particles such as oil have been separated, to the fresh air supply 3. The resulting fresh air flow 41 is compressed by means of a compressor wheel 39 and fed to the internal combustion engine 1 through the cylinder head 11 by means of a charge air cooler 43. Combustion gases that do not reach the crankcase 15 between the piston 17 and the cylinder 13 are fed to a turbocharger 47 in the form of exhaust gas 45 by means of an exhaust gas discharge, wherein said turbocharger drives the compressor wheel 39 in the fresh air supply 3 via a shaft 49.

It should be clear that the installation position of the inventive separating device 51 is in an application as an oil separator in internal combustion engines not limited to the installation position illustrated in FIG. 1 and also not limited to the use in a crankcase ventilation system 29. For example, the separating device 51 could also be used for separating particles from gas flows that exit the internal combustion engine 1 between the cylinder 13 and the cylinder head 11 and/or between the cylinder head 11 and the cylinder head cover 9. Another potential field of application can be seen in the fresh air supply 3 and/or in the exhaust gas discharge 5, which particularly may be fluidically coupled to one another by means of the shaft 49 connecting the compressor wheel 39 and the turbine wheel 47.

Figure 2:
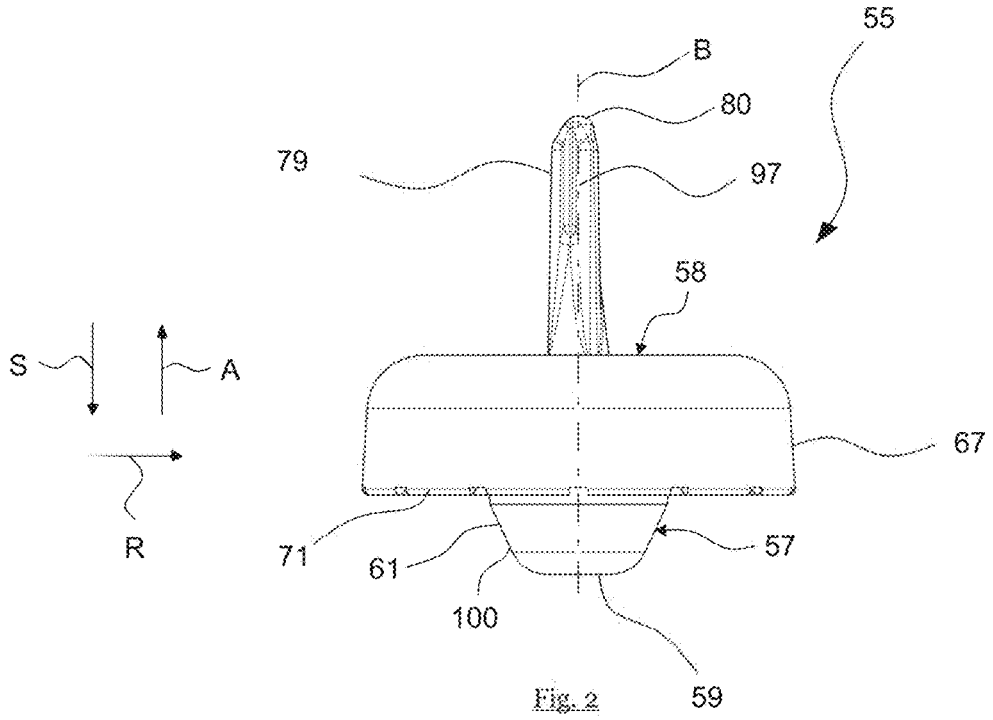
FIG. 2 shows a side view of a first embodiment of a valve element for a separating device.
Figure 3:
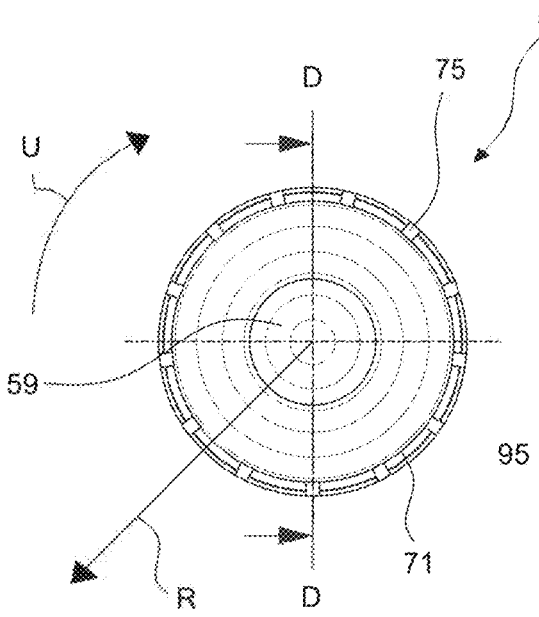
FIG. 3 shows a bottom view of the valve element according to FIG. 2.
Figure 4:
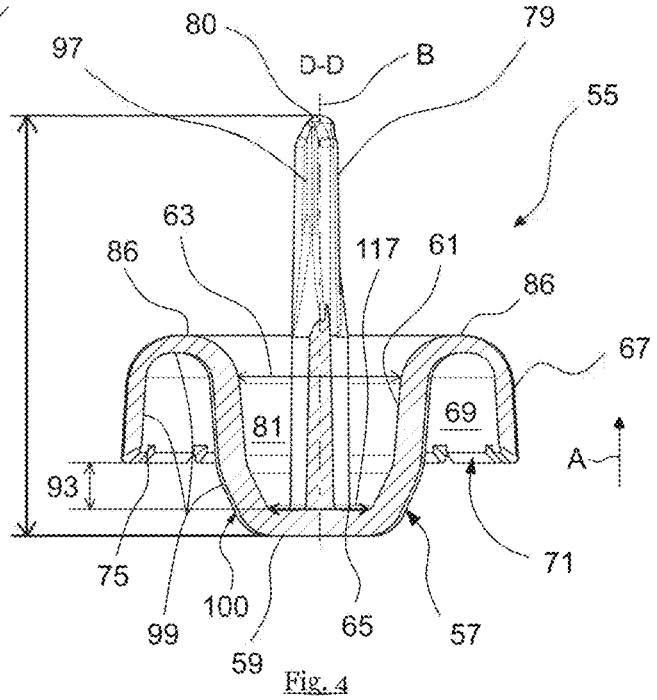
FIG. 4 shows a section through the valve element according to FIG. 2 along the line of section D-D in FIG. 3.

FIGS. 2 to 4 show a first embodiment of a valve element 55 for an inventive separating device 51 in the form of a side view (FIG. 1), a bottom view (FIG. 3) and a sectional view along the line of section D-D (FIG. 4). An axial actuating direction, in which the valve element 55 moves during a displacement from the closed position into the open position, is identified by the reference symbol A below. The radial direction extending perpendicular to the actuating direction A is identified by the reference symbol R below. The valve element 55 comprises a bowl 57 with a bowl base 59 that essentially extends in the radial direction R, particularly in a disk-shaped manner. A shell 61 essentially extends from the bowl base 59 in the actuating direction A. The shell 61 and the bowl base 59 form a bowl 57 that is open toward a side 58 in the actuating direction A. The shell 61 is tapered in a closing direction S extending opposite to the actuating direction A and leads into the disk-shaped bowl base 59. The bowl base 59 and the shell 61 are realized rotationally symmetrical, wherein the taper of the shell 61 is limited in such a way that the maximal inside diameter 63 of the shell 61 is no more than 30%, 50%, 70% or 110% greater than the minimal inside diameter 65 of the shell 61.

A valve element collar 67 respectively borders on or leads into the shell 61, particularly the end of the shell 61 pointing in the actuating direction A. The valve element collar 67 is realized rotationally symmetrical and initially extends from the shell 61 essentially in the radial direction R, particularly in an arc-shaped manner, and then essentially in the closing direction S. The valve element collar 67 and the bowl 57, particularly the shell 61, define an annular space 69 of the valve element 55 that is open in the closing direction S.

The end of the collar 67 in the closing direction S forms at least one essentially circumferential abutting contact surface 71 of the valve element 57 for the abutting contact between the valve element 57 and the valve seat 73. The circumferential direction is identified by the reference symbol U below. According to FIGS. 2 to 10, the abutting contact surface 71 of the valve element 57 may be contoured in order to allow a fluid passage in the closed position of the separating device 51. The contouring of the at least one abutting contact surface 71 may comprise at least one projection and/or at least one depression 75. In the exemplary embodiments shown, the contouring comprises multiple depressions 75 (recesses) in the abutting contact surface 71 of the valve element collar 67. The multiple depressions 75 are circumferentially distributed on the contouring, particularly on the valve seat collar, in an equidistant manner. In the present embodiment, the contouring comprises thirteen depressions 75. However, more or fewer depressions 75 may also be provided. In the examples shown, the depressions 75 are illustrated with an exemplary rectangular cross section. However, they may also have other cross-sectional shapes such as, for example, that of a circle, an ellipse, a triangle, a pentagon, etc. It proved advantageous to incline the depressions 75 downstream in the closing direction S starting from a plane extending in the radial direction R in order to direct the passage taking place through the contouring at the abutting contact surface 77 of the valve seat 73, wherein the separation rate, i.e. the efficiency of the separating device 51, can thereby be increased.

A guide pin 79 extends from the bowl base 59 in order to guide a spring and/or the valve element in the actuating direction A. The guide pin 79 particularly extends along a rotational axis of symmetry of the bowl 57 and/or the collar 67, which is identified the reference symbol B, and beyond the collar 67 and the bowl 57 in the actuating direction A. In the closing direction S extending opposite to the actuating direction A, the guide pin 79 extends beyond the abutting contact surface 71 of the valve element 55, particularly the valve element collar 71. The guide pin 79 and the bowl 57, particularly the shell 61, define an annular space 81 that is open in the actuating direction A and particularly becomes larger in the actuating direction A. According to FIGS. 11 and 12, the annular space 81 between the guide pin 79 and the bowl 57 particularly serves for accommodating a spring 83 that is supported on the bowl 57, particularly on the bowl base 59, and causes a displacement in the closing direction S.

An inventive device for separating particles such as oil particles from a gas flow, from a blow-by gas of a crankcase ventilation 7, in an internal combustion engine comprises a valve seat 73 that defines a flow passage opening 109 and a movable valve element 55 that can be displaced between a closed position, in which the valve element 55 is in abutting contact with the valve seat 73, and at least one open position, in which the valve element 55 is moved from the axial abutting point in an axial actuating direction A.

According to the above-described first embodiment of the inventive separating device 51, the valve element 55 comprises a rotationally symmetrical bowl 57 upstream of the gas flow, particularly on an axial end 84 of the valve element 55. The bowl 57 furthermore has a bowl base 59, which according to one embodiment axially protrudes past the abutting point opposite to the axial actuating direction A, i.e. in the closing direction S, by at least 5 mm, particularly by at least 10 mm, such as by at least 10%, 20%, 30%, 40% or 50% of the longitudinal extent of the valve element. The abutting point particularly is defined by the common contact surfaces 71, 77 of the valve seat 73 and an abutting contact surface 71 of the valve element 55 in the closed position. In the embodiments illustrated in FIGS. 11 and 12, the abutting point is formed by the abutting contact surface 71 of the valve element 73. The bowl base 59 serves as a supporting point 117 for a spring, which is supported on the valve element 55 with an axial end in the closing direction S and on the housing 110, particularly on the cover part 113 of the housing 110, with the other axial end in the actuating direction A. Since the bowl base 59 axially protrudes past the abutting point, particularly the abutting contact surface 71 of the valve element 73, in the closing direction S, the supporting point 117 of the spring 82 may likewise protrude past the abutting point in the closing direction S. The available spring travel can thereby be increased without increasing the overall extent of the separating device 51 in the actuating direction A. In this way, the overall axial extent of the separating device 51 required for the desired actuating travel particularly is partially shifted in the closing direction S for the benefit of the axial extent in the actuating direction A.

According to the above-described embodiment separating device 51, the valve element 55 does not necessarily comprise a bowl 57. In this embodiment, it is particularly important that the supporting point 117 of the spring 83 on the valve element 55 protrudes past the abutting point, particularly the abutting contact surface 71 of the valve element 73. Analogous to the prior described embodiment, the overall axial extent of the separating device 51 required for the actuating travel is thereby partially shifted in the closing direction S for the benefit of the axial extent in the actuating direction A.

Figure 5:
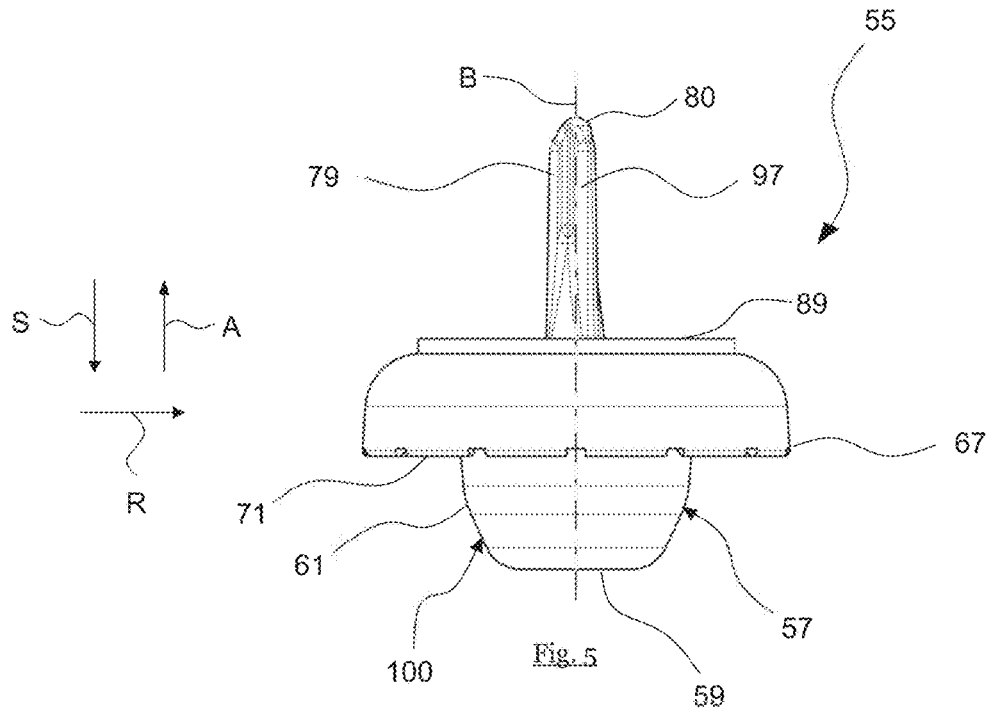
FIG. 5 shows a side view of a second embodiment of a valve element for a separating device.
Figure 6:
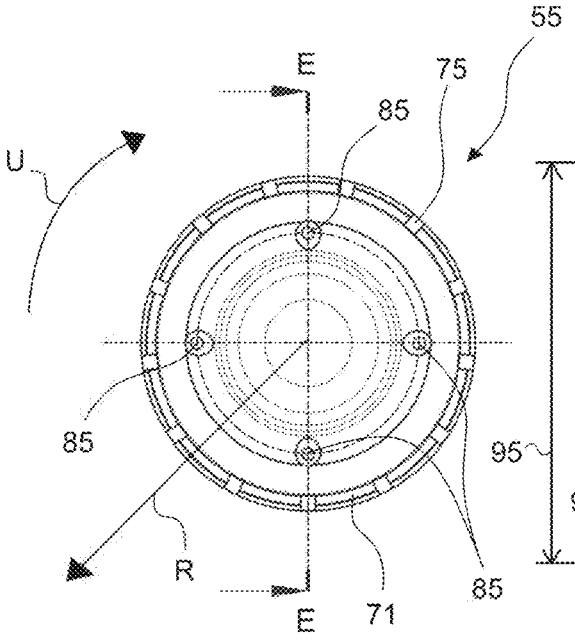
FIG. 6 shows a bottom view of the valve element according to FIG. 5.
Figure 7:
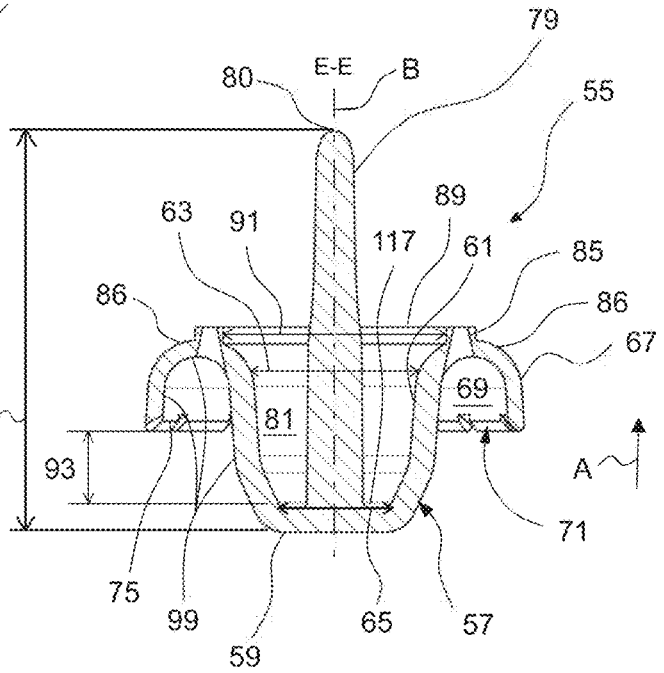
FIG. 7 shows a section through the valve element according to FIG. 5 along the line of section E-E in FIG. 6.

FIGS. 5 to 7 show a second embodiment of a valve element 55 for an inventive separating device 51 in the form of a side view (FIG. 5), a bottom view (FIG. 6) and a sectional view along the line of section E-E (FIG. 7). Corresponding characteristics are identified by the same reference symbols in order to improve the readability of the application. At least one leakage element 85 is formed in the valve element 55 in this second embodiment of the valve element 55 of an inventive separating device 51. According to FIG. 6, in particular, multiple leakage elements 85 are formed in the valve element 55 according to the second embodiment. The leakage elements 85 are realized in the form of bores that are tapered in the actuating direction A. Due to this taper, the gas flow is accelerated during its passage through the leakage elements 85 such that the separation of particles is promoted. In alternative embodiments, the leakage elements 85 could also be realized in the form of bores that widen in the actuating direction A or in the form of bores with constant cross section. It is likewise not mandatory that the bores have the round shape shown. The bores could also have an elliptical shape or be realized angularly. The leakage elements 85 are located in a reversal section 86 of the bowl 57, which protrudes farthest in the actuating direction A and into which the shell 61 and the collar 67 lead, and essentially extend in the actuating direction A. Leakage elements 85 may alternatively or additionally be formed, for example, in the shell 61 and essentially extend in the radial direction R (in a not-shown manner) or formed in the bowl base 59 and essentially extend in the actuating direction A (in a not-shown manner).

In order to additionally improve the separation rate of separating devices, the inventive separating device 51 may comprise a fibrous web 87, which is arranged on the separating device 51 in such a way that the gas flow impinges upon and/or flows through the fibrous web 87. When a fibrous web 87 is used as illustrated, for example, in FIGS. 11 and 12, it proved advantageous to provide a ring 89 on the end of the collar 67 or the shell 61 in the actuating direction A, wherein the inside diameter 91 of said ring is greater than or equal to the maximal inside diameter 63 of the shell 61. In this case, the leakage elements 85 extend through the collar 67 and the ring 89 in the actuating direction A. It proved advantageous to provide between two and ten leakage elements 85, such as between two and eight leakage elements, particularly between two and six leakage elements, in the actuating element 57, wherein said leakage elements particularly are arranged equidistant from one another in the circumferential direction U.

An axial extent 93 between the abutting surface 71 of the valve element 57 and the bowl base 59 in the actuating direction A of the guide pin 79 can be adapted in relation to an overall axial extent 95 in the actuating direction A of the valve element 55, particularly shifted in the closing direction S extending opposite to the actuating direction A, in order to reduce the required structural space in the actuating direction A. It proved advantageous to realize an axial extent 93 of the guide pin 79 between the abutting surface 71 of the valve element 57 and the bowl base 59 such that it corresponds to at least 10%, 20%, 30%, 40% or 50% of the overall axial extent 95 of the valve element 55. The axial extent 93 of the guide pin 79 between the abutting surface 71 of the valve element 57 and the bowl base 59 amounts to approximately 12.5% of the overall axial extent of the valve element 57 in the embodiment according to FIGS. 2 to 4 and to approximately 20% in the embodiment according to FIGS. 5 to 7. In this way, the axial extent of the valve element and the separating device, into which the valve element is inserted, can be shifted in the closing direction S in order to thereby reduce the axial extent in the actuating direction A. According to FIG. 7, the guide pin 79 is tapered in the actuating direction A. The taper begins approximately at the axial height of the valve element collar 67 and extends over a short section in the actuating direction A, e.g. over approximately 10% of the overall axial extent 95 of the guide pin 79, wherein the guide pin 79 then continues to extend in the actuating direction A with constant cross section. Viewed in the actuating direction A, at least one guide lug 97 particularly extends in the radial direction R on an upper end 80 of the guide pin 79 in the actuating direction A, wherein multiple guide lugs 97 are provided as an example and essentially distributed on the guide pin 79 in the circumferential direction U. The guide lugs 97 particularly serve for guiding the guide pin 79, in a housing of the separating device 51, wherein the guide lugs 97 particularly may engage into (not-shown) guide grooves provided for this purpose.

The valve elements 55 illustrated in FIGS. 2 to 12 comprise flow guide surfaces 99 for deflecting the gas flow such that particles are separated from the gas flow due to the impact of the particles on the flow guide surfaces 99. In this context, the surfaces of the valve element 55, which come in contact with the gas flow and deflect and/or guide this gas flow, are referred to as flow guide surfaces 99. The flow guide surfaces 99 particularly are formed on an outer surface 100 of the valve element 55, which faces away from the axial actuating direction A. The flow guide surfaces 99 are formed by the bowl 57, particularly the shell 61, and the valve element collar 67. The flow guide surfaces 99 of the valve element 55 define the annular space 69, which is open in the closing direction S, such that a gas flow flowing toward the valve element 55 in the actuating direction A is deflected and/or guided.

Figure 8:
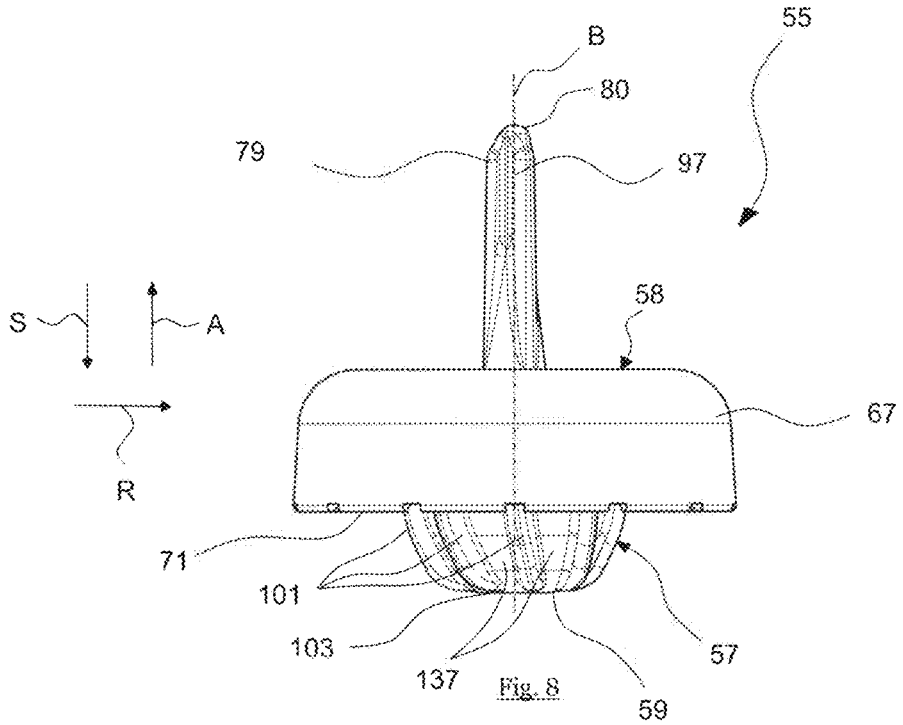
FIG. 8 shows a side view of a third embodiment of a valve element for a separating device.
Figure 9:
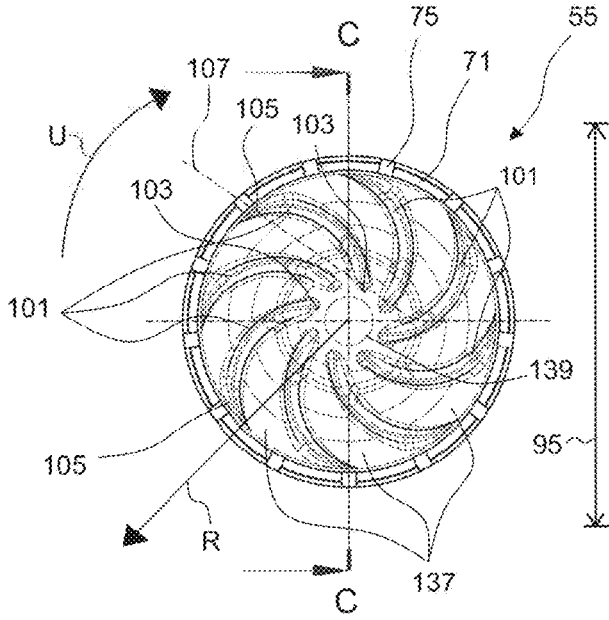
FIG. 9 shows a bottom view of the valve element according to FIG. 8.
Figure 10:
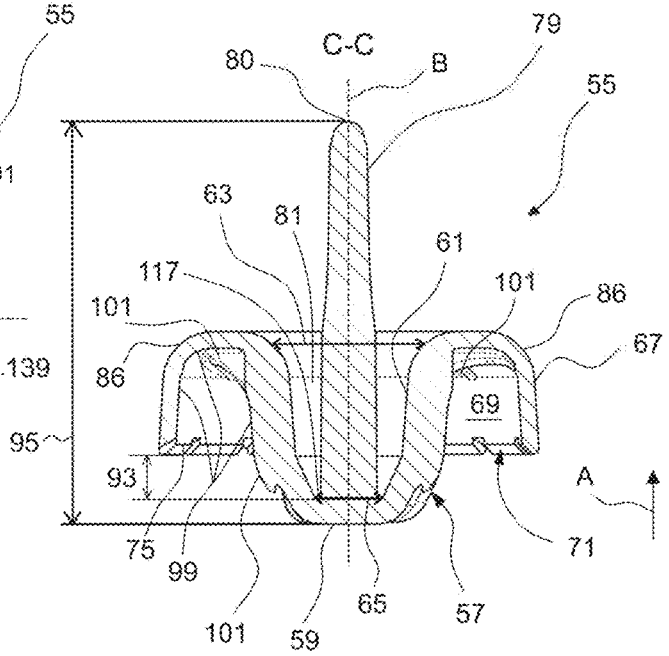
FIG. 10 shows a section through the valve element according to FIG. 8 along the line of section C-C in FIG. 9.

FIGS. 8 to 10 show a third embodiment of a valve element 55 for an inventive separating device 51 in the form of a side view (FIG. 8), a bottom view (FIG. 9) and a sectional view along the line of section C-C (FIG. 10). Corresponding characteristics are identified by the same reference symbols in order to improve the readability of the application.

The flow guide surfaces 99 of the valve element 55 comprise at least one turbine blade-like guide projection 101 that transforms the gas flow into a swirling flow in order to increase the separation rate of the separating device 51, wherein at least one turbine blade-like guide depression may alternatively or additionally be provided for this purpose. According to the embodiment in FIGS. 8 to 10, multiple guide projections 101 are provided in order to improve the effect thereof. The turbine blade-like guide projections 101 extend along the bowl 57 of the valve element 55, particularly along the shell 61. It proved advantageous to form the guide projections 101 on the shell 61 of the bowl 57. The guide projections 101 may alternatively or additionally also be provided on the valve element collar 67 and/or on the bowl base 59 of the valve element 55. It is furthermore possible to arrange additional or alternative guide projections 101 and/or guide depressions on flow guide surfaces of the valve seat 73 (in a not-shown manner) in order to additionally increase the separation rate.

The guide projections 101 according to the exemplary embodiment are realized helically. In this case, the guide projections 101 particularly are realized in the form of continuously extending material webs that helically extend about a rotational axis of symmetry B of the valve element 55. The guide projections 101 respectively comprise an inflow profile lug 103 and an inflow profile rear edge 105, wherein the gas flow impinging upon the valve element 55 initially comes in contact with the inflow profile lug 103, is then guided along the flow guide surfaces 99 by means of the guide projections 101 in order to form a swirling flow and ultimately exits the guide projections 101 along the inflow profile rear edge 105. A connecting line between the inflow profile lug 103 and the inflow profile rear edge 105 forms a profile chord that is indicated with a reference line 107 and extends askew with respect to a main flow direction, particularly the actuating direction A. In an embodiment, in which the guide projections 101 are helically realized on the shell 61, the profile chord 107 can starting from the profile lug 103 be described as a vector that has a component in the radial direction R, a component in the axial actuating direction A, as well as a component in the circumferential direction U, particularly an angular offset in the circumferential direction U. However, a vector describing the profile chord 107 does not have to have each of these directional components. For example, profile chords that only have components in the radial direction R and in the circumferential direction U, in the radial direction R and in the actuating direction A or in the circumferential direction U and in the actuating direction A would also be conceivable. Eight rotationally symmetrical guide projections 101 are provided in the example illustrated in FIGS. 8 to 10. The guide projections 101 are arranged on the respective flow guide surfaces 99 of the valve element 55 such that they are uniformly distributed in the circumferential direction U.

Figure 11:
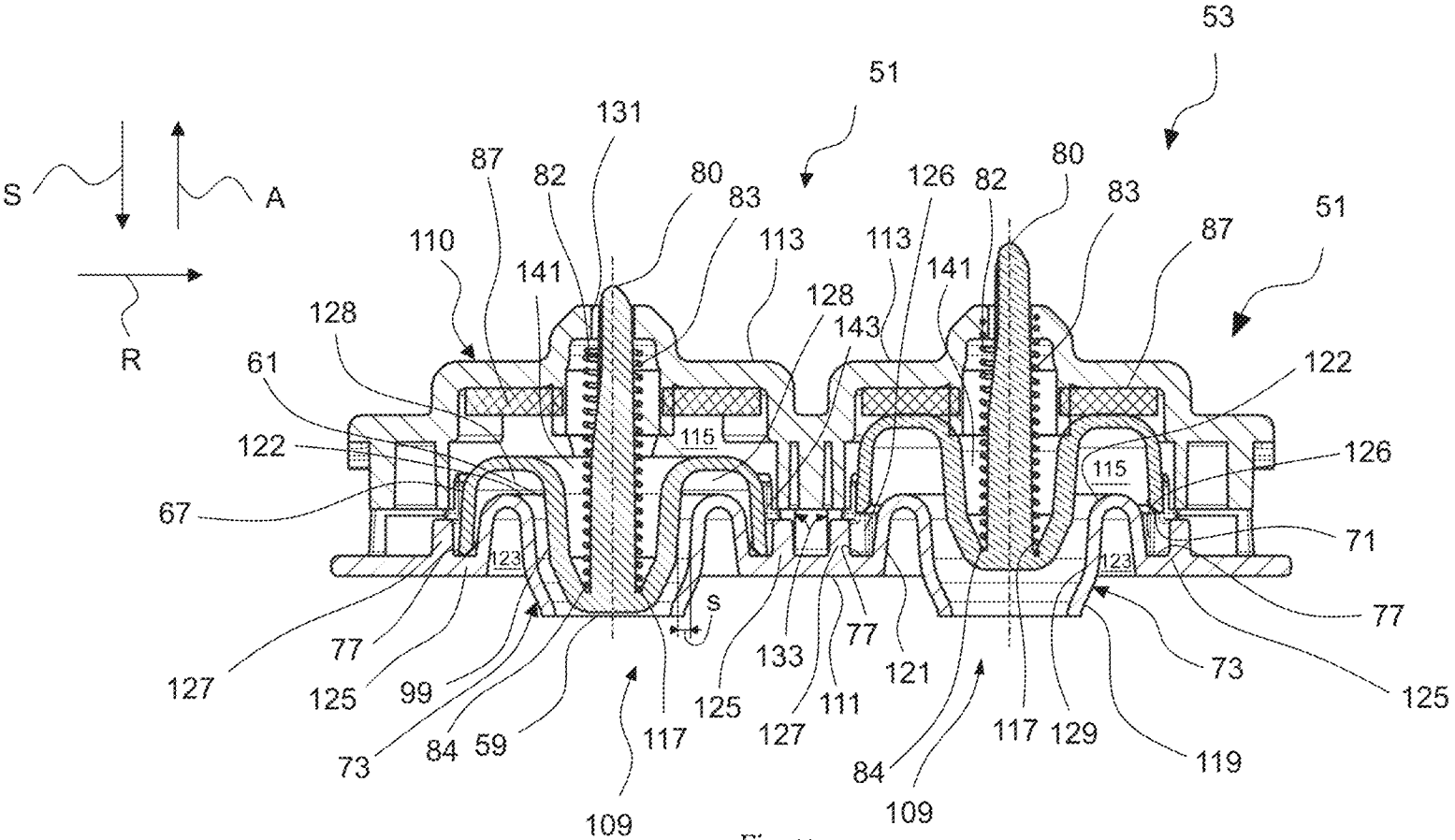
FIG. 11 shows a sectional view of a first embodiment of a particle separator with two separating devices, wherein the left separating device is illustrated in the closed position and the right separating device is illustrated in the open position.
Figure 12:
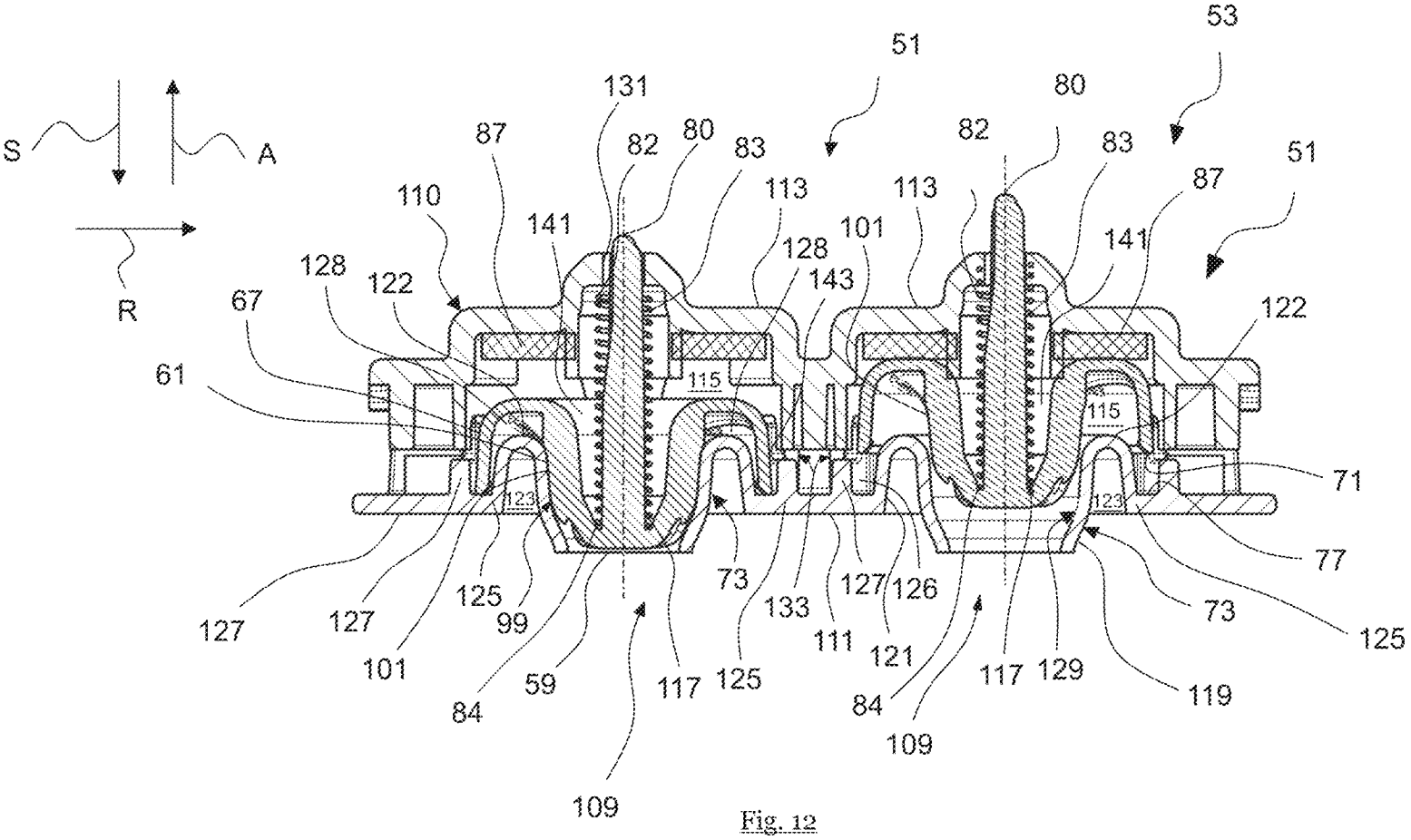
FIG. 12 shows a sectional view of a second embodiment of a particle separator with two separating devices, wherein the left separating device is illustrated in the closed position and the right separating device is illustrated in the open position.

FIG. 11 and FIG. 12 respectively show an embodiment of an inventive particle separator 53. As an example, the particle separator 53 comprises two inventive separating devices 51 that are fluidically connected to one another, wherein the left separating device 51 is illustrated in the closed position and the right separating device 51 is illustrated in the open position. The valve elements 55 of the separating device 51 illustrated in FIG. 11 approximate the valve element 55 illustrated in FIGS. 2 to 4 and particularly can be distinguished by a larger annular space 69 between the valve element collar 67 and the bowl 57. The valve elements 57 illustrated in FIG. 12 correspond to the valve element illustrated in FIGS. 8 to 10. Corresponding characteristics are identified by the same reference symbols in order to improve the readability of the application.

The separating devices 51 of the particle separator 53 are arranged parallel to one another and fluidically connected to one another. In this context, the term arranged parallel to one another refers to the separating devices 51 being arranged in such a way that a gas flow impinging upon the particle separator 53 can simultaneously flow into both separating devices 51 or be divided between the two separating devices 51, respectively. Each separating device 51 has a flow passage opening 109, by means of which a gas flow impinging upon the particle separator 53 can be divided between both separating devices 51. Although FIGS. 11 and 12 merely show the coupling of two separating devices 51 in the form of a particle separator 53, it should be clear that the preceding and following description of the separating devices 51 applies to a particle separator 53 with two separating devices 51, as well as to an individual separating device 53 and to a particle separator 53 with more than two parallel separating devices 51.

The separating device 51 particularly comprises a two-part housing 110. The housing comprises an inflow housing part 111 and a cover part 113 that respectively is or can be connected thereto. The inflow housing part 111 and the cover part 113 particularly may be separably connected to one another by means of a (not-shown) clip connection. The inflow housing part 111 particularly may be connected to the crankcase by means of a (not-shown) tongue-and-groove connection. In one embodiment, the inflow housing part 111 can be connected to the crankcase by means of a tongue-and-groove connection. The separating device 51 comprises a valve seat 73 that defines the flow passage opening 109. The valve seat 73 forms part of the housing 110, particularly the inflow housing part 111. The valve seat 73 and the inflow housing part 111 are made of one piece. In the particle separator 53 shown, the valve seats 73 of the two separating devices 51 and the inflow housing parts 111 are made of one piece. The cover parts 113 of the two separating devices 51 are likewise made of one piece. For example, die casting methods may be used for this purpose.

The housing 110 defines a separation space 115 for separating particles from the gas flow and for accommodating and guiding the valve element 55. The valve element 55 is mounted in the separation space 115. In the closed position, the valve element 55 is in abutting contact with the valve seat 73. During this abutting contact, the abutting contact surface 71 of the valve element 55 and the abutting contact surface 77 of the valve seat 73 contact one another. In this case, the valve element 55 is pressed against the valve seat 73 by means of a spring 83 that is supported on the valve element 55 with an axial end 84. An axial end 82 of the spring 83 lying opposite of the axial end 84 is supported on the cover part 113 of the housing. When the valve element 55 is acted upon by a gas flow with sufficient pressure, it is moved from the closed position into an open position in the actuating direction A. In this case, the gas flow acts against the spring force of the spring 83, wherein it would also be possible, for example, to provide a multi-spring arrangement such as a serial arrangement of at least two springs 83. The spring 83 supported between the valve element 55 and the housing cover 113 is compressed during a displacement of the valve element 55 in the actuating direction A. The spring force acting against the displacement motions of the valve element 55 increases as the displacement of the valve element 55 progresses in the actuating direction A. The spring characteristic can be adapted to a desired response characteristic of the valve element 55 by using springs with progressively coiled spring characteristic and/or by using a serial arrangement of multiple springs.

The spring 83 is placed over the guide pin 79 that extends from the bowl 57, particularly from the bowl base 59, in the actuating direction A. A passage opening 131 for the guide pin 79, into or through which the guide pin 79 respectively protrudes, is provided in a part of the housing, particularly the cover part 113, which lies opposite of the bowl base 59 in the actuating direction A. The passage opening 131 is dimensioned in such a way that it guides the valve element 55 during a displacement in the actuating direction and/or the closing direction A, S.

The space requirement of the spring 83, particularly in the actuating direction A, is reduced in that the spring 83 is supported on the bowl 57, especially on the bowl base 59, wherein a supporting point 117 is viewed in the actuating direction A formed at a lowest point on a bowl side pointing in the actuating direction A. The space requirement for the spring 83 is alternatively or additionally reduced in that the supporting point 117 of the spring 83 and/or the bowl base 59 axially protrudes past the abutting point 71, 77 opposite to the actuating direction A in the closed position of the valve element 55. In this way, the overall extent of the separating device 51 required for the actuating travel of the spring 83 particularly can be partially shifted in the closing direction S in favor of the extent in the actuating direction A. This also makes it possible, in particular, to reduce the overall axial extent of an arrangement, particularly a crankcase ventilation system 29, which comprises a separating device 51 and a gas flow source that is connected to the separating device 51 upstream and particularly may be realized in the form of a crankcase, from which blow-by gas flows into the separating device. In this case, the invention utilizes the fact that the extent, which is shifted in the closing direction S in favor of the axial extent in the actuating direction A, protrudes into an already available structural space of the gas flow source such that the actuating travel of the spring 83 can be increased without reducing the overall axial extent of the arrangement.

The valve seat 73 is realized rotationally symmetrical. The valve seat 73 particularly comprises a hollow body 119 that is shaped complementary to the bowl 57 of the valve element 55. The bowl 57 and/or the hollow body 119 is tapered in the closing direction S. In this case, the bowl 57 and the hollow body 119 particularly are shaped complementary to one another. The bowl 59 can be telescopically displaced into the hollow body 119 in order to displace the valve element 55 into the closed position and/or open position. Due to the complementary design of the bowl 57 and the hollow body 119, the valve element 55 is guided in the actuating/closing direction A, S by the valve seat 73, particularly the hollow body 119, during a displacement in the actuating direction and the closing direction A, S. It should be clear that a certain relative motion of the guided valve element 55 is possible in a direction extending transverse, especially perpendicular, to the actuating/closing direction A, S. In fact, the term guided respectively refers to the motion of the guided part, i.e. the valve element 55, at least being restricted in other directions or to centering of the part, i.e. the valve element 55, taking place due to the guidance.

The term guidance is elucidated below with reference to the example illustrated in FIGS. 11 and 12. According to FIG. 11, a clearance s in the radial direction R exists between the bowl 57 and the hollow body 119 in the present guidance such that the guidance of the hollow body 119 allows a certain motion in the radial direction R. According to FIG. 12, in contrast, no clearance or hardly any clearance exists between the bowl 57 and the hollow body 119 in the closed position and only a slight clearance s in the radial direction R exists between the bowl 57 and the hollow body 119 in the maximal open position, which is illustrated in the right portion of FIG. 12. This clearly shows that the turbine blade-like guide projections 101 on the shell 61 may also fulfill a guiding function in addition to the function of transforming the gas flow into a swirling flow. Due to the arrangement of guide projections 110 or guide depressions on the bowl 57, this bowl may be in physical contact with the hollow body 119 and at the same time allow a through-flow between the bowl 57 and the hollow body 119.

The valve seat 73 furthermore comprises a valve seat collar 121 that leads into the hollow body 119. In this case, the valve seat collar 121 initially extends in the radial direction A in an arc-shaped manner from an end 122 of the hollow body 19 in the actuating direction A and then essentially in the closing direction S. The hollow body 119 and the valve seat collar 121 define an annular space 123 that is opened in the closing direction S. The hollow body 119 and the valve seat collar 121 protrude into the annular space 115 defined by the valve element 55. In the closed position, the hollow body 119 and the valve seat collar 121 particularly are enclosed by the valve element 55 in the radial direction R.

The axial abutting point 77 (abutting contact surface of the valve seat 73) is formed by a radial web 125, into which the valve seat collar 121 leads. An axial web 127, which essentially extends in the actuating direction and the closing direction A, S, borders on the radial web 125 in the radial direction R. The valve seat collar 121, the radial web 125 and the axial web 127 define an annular gap 126 that is open in the actuating direction A and particularly guides the valve element 55 during a displacement in the actuating direction and in the closing direction S.

The valve elements 55 and valve seats 73 illustrated in FIG. 11 are realized in a collar-shaped manner and particularly can be telescopically displaced inside one another such that a collar-shaped gap 128 is formed between the valve element 55 and the valve seat 73, particularly in the closed position. The collar-shaped gap 128 particularly is formed between flow guide surfaces 129 of the valve seat 73 and flow guide surfaces 99 of the valve element 55. The flow guide surfaces 129 of the valve seat 73 particularly are formed by the inner surfaces of the hollow body 119 referred to the radial direction R, which come in contact with the gas flow, and by the outer surface of the valve seat collar 121 referred to the radial direction R. The collar-shaped gap 128 causes a deflection of the gas flow by at least 130°, 140°, 150°, 160°, 170° or 180°, wherein the gas flow flows between the flow guide surfaces 99, 129 of the valve element 55 and the valve seat 73.

In the separating devices 51 illustrated in FIG. 12, multiple helical gaps 137 (see particularly FIGS. 8 and 9) extending in the actuating direction A are formed between the actuating element 55 and the valve seat 73 by the turbine blade-like guide projections 101, which are in physical contact with the hollow body 119. In this case, the helical gaps 137 are defined by flow guide surfaces 99 of the valve element 55 on the shell 61 and on the turbine blade-like guide projections 101, as well as by flow guide surfaces 129 of the hollow body 119. The helical gaps 137 transform into a rotationally symmetrical gap 139 (see particularly FIG. 9), which is defined by flow guide surfaces between the valve element collar 67 and the valve seat collar 121, downstream of these helical gaps.

The valve element 55 divides the separation space 115 defined by the housing 110 into a flow space between the valve element 55 and the valve seat 73 and a bypass space 141 between the valve element 55 and the cover part 113. The gas flow flows through the flow space along the flow guide surfaces 99, 129 between the valve seat 73 and the valve element 55. The gas flow can reach the bypass space 141, in which particles can also be separated, through leakage elements 85 in the valve element 55, e.g. leakage elements of the type illustrated in the embodiment according to FIGS. 5 to 7. In the separating devices 51 illustrated in FIGS. 11 and 12, a fibrous web 87, on which particles can be separated, is provided in the bypass space 141. In this case, the gas flow does not have to flow through the fibrous web 87. It suffices if the gas flow impinges upon the fibrous web 87 in order to separate particles thereon. The fibrous web 87 is realized in a disk-shaped manner, especially annularly, and fastened on the cover part 113 of the housing 110.

A separating nozzle 133 with constant through-flow cross section is arranged downstream of the valve element 55 for the nebulization and/or defined discharge of the gas flow. The separating nozzle particularly forms at least one gap between the housing cover 113 and the inflow housing part 111 in the installed state. Since the housing cover 113 and the inflow housing part 111 essentially are fastened to one another in an immovable manner, the cross section of the gap and therefore the through-flow cross section of the separating nozzle 133 essentially remain constant regardless of the position of the valve element 55. Due to this constant through-flow cross section, a minimal particle separation by means of the at least one separating nozzle 133 can also be ensured when the valve element 55 is completely opened. The separating nozzle 133 is arranged downstream of the abutting contact between the valve element 55 and the valve seat 73. An annular gap between the abutting contact surface 71 of the valve element 55 and the abutting contact surface 77 of the valve seat 73 is formed in the maximal open position. The through-flow cross section of this annular gap, particularly a clearance between the abutting contact surfaces 71, 77 of the valve element 50 and the valve seat 73 in the actuating direction A, is greater, especially at least 20%, 40%, 60%, 80% or 100% greater, than the maximal through-flow cross section of the separating nozzle 133, particularly than the axial extent of the gap between the housing cover 113 and the inflow housing part 111.

According to FIGS. 11 and 12, at least two separating devices 51 can be fluidically connected to one another into a particle separator 53 in such a way that a gas flow can flow from one separating device 51 into the other separating device 51. The separating devices 51 particularly are fluidically connected to one another downstream of the separating nozzle 133. An exemplary embodiment of such a fluidic connection is illustrated in FIGS. 11 and 12. In this case, a gas flow can exit the separation space 115 of one separating device 51 through its separating nozzle 133 and enter the separation space 115 of the other separating device 51 through its separating nozzle 133.

A separation space connecting gap 143 is provided between the valve element 55 and the separating nozzle 133, particularly between the separating nozzle 133 and the valve element collar 67, wherein the gas flow can flow from the flow space into the bypass space 141 and vice versa through said connecting gap. Contouring of the abutting surfaces 71, 77 also enables a gas flow to flow from one separating device 51 into the other separating device and vice versa in the closed position of both valve elements 57. Contouring of the abutting surfaces 71, 77 furthermore enables a gas flow to flow from the flow space into the bypass space 141 and vice versa in the closed position when valve elements 79 without leakage elements 85 are used.

The characteristics disclosed in the preceding description, the figures and the claims may be important for realizing the different embodiments of the invention individually, as well as in arbitrary combinations.

LIST OF REFERENCE SYMBOLS

1 Internal combustion engine
3 Fresh air supply
5 Exhaust gas discharge
7 Crankcase ventilation
9 Cylinder head cover
11 Cylinder head
13 Cylinder
15 Crankcase
17 Piston
19 Swept volume
21 Crankcase interior
23 Gas flow
25 Flow outlet opening
27 Flow passage opening
29 Crankcase ventilation system
31 Return pipe
33 Return outlet
35 Return inlet
37 Return pipe
39 Compressor wheel
41 Fresh air flow
43 Charge air cooler
45 Exhaust gas
47 Turbocharger
49 Shaft
51 Separating device/device
53 Particle separator
55 Valve element
57 Bowl
58 Bowl side
59 Bowl base
61 Shell
63 Maximal inside diameter of shell
65 Minimal inside diameter of shell
67 Valve element collar
69 Annular space between bowl and valve element collar
71 Abutting contact surface of valve element
73 Valve seat
75 Contouring depression
77 Abutting contact surface of valve seat
79 Guide pin
80 End
81 Annular space between guide pin and bowl
83 Spring
82, 84 Axial end
85 Leakage element
86 Reversal section
87 Fibrous web
89 Ring
91 Inside diameter of ring
93 Axial extent of guide pin
95 Overall axial extent of valve element
97 Guide lug
99 Flow guide surface of valve element
100 Outer surface
101 Guide projection
103 Inflow profile lug
105 Inflow profile rear edge
107 Profile chord
109 Flow passage opening
110 Housing
111 Inflow housing part
113 Cover part
115 Separation space
117 Supporting point of spring on valve element
119 Hollow body of valve element
121 Valve seat collar
122 End

123 Annular space between hollow body and valve element collar
125 Radial web
126 Radial gap
127 Axial web
128 Gap
129 Flow guide surfaces of valve seat
131 Passage opening for guide pin
133 Separating nozzle
135 Outlet pipe
137 Gap
139 Gap
141 Bypass space
143 Separation space connecting gap
A Actuating direction
S Closing direction
R Radial direction
U Circumferential direction
B Rotational axis of symmetry
s Clearance

The invention claimed is:

1. A device for separating particles from a gas flow, with a blow-by gas of a crankcase ventilation in an internal combustion engine, the device comprising:

a valve seat that defines a flow passage opening; and a valve element that can be displaced between a closed position, in which the valve element is in abutting contact with the valve seat and the abutting contact defines an axial abutting point, and at least one open position, in which the valve element is moved from the axial abutting point in an axial actuating direction (A), wherein the valve element has a rotationally symmetrical bowl upstream of the gas flow;

wherein a base of the bowl axially protrudes past the abutting point opposite to the axial actuating direction (A) by at least 10% of the longitudinal extent of the valve element.

2. The device according to claim 1, wherein the bowl base supports a spring, which causes a displacement into the closed position, wherein the bowl base is realized in a disk-shaped manner and/or wherein the bowl has a shell, which extends from the bowl base in the actuating direction (A), or a guide pin, which extends centrally from the bowl base in the actuating direction (A) and serves for guiding the spring and/or the valve element, and wherein an annular space, which a becomes larger in the actuating direction (A), particularly is formed between the guide the pin and the shell.

3. The device according to claim 2, wherein the valve seat forms a rotationally symmetrical hollow body, which is shaped complementary to the bowl and tapered in a closing direction (S) extending opposite to the actuating direction (A), wherein the bowl can be telescopically displaced into the actuating position and the closed position inside the hollow body or wherein the hollow body guides the valve element during a displacement in the actuating direction and the closing direction (S) and/or wherein the hollow body defines the flow passage opening.

4. The device according to claim 1, wherein the valve element has a collar, which leads into the bowl and defines an annular space that is open in a closing direction (S) extending opposite to the actuating direction (A) together with the bowl.

5. The device according to claim 4, wherein the valve seat has a collar, which particularly leads into the hollow body and especially protrudes into the annular space between the bowl and the valve element collar, wherein the valve seat collar defines an annular space that is open in the closing direction (S) and particularly defines an annular space that is open in the closing direction (S) together with the hollow body.

6. The device according to claim 1, wherein the axial abutting point is formed by a radial web, which extends in a radial direction (R) that is oriented perpendicular to the actuating direction (A) and leads into the valve seat collar, further wherein the valve seat collar, the radial web and an axial web extending from the radial web in the actuating direction (A) particularly define an annular gap that is open in the actuating direction (A), and further wherein the annular gap particularly guides the valve element during a displacement in the actuating direction and in the closing direction (S).

7. The device according to claim 1, wherein at least one leakage opening is arranged in the valve element, in the bowl, wherein the leakage opening allows a fluid return such as a drainage, of separated particles, opposite to the actuating direction (A) and/or a fluid passage in the closed position.

8. A device for separating particles from a gas flow, with a blow-by gas of a crankcase ventilation in an internal combustion engine, the device comprising:

a valve seat that defines a flow passage opening;

a movable valve element that can be displaced between a closed position, in which the valve element is in abutting contact with the valve seat and the abutting contact defines an axial abutting point, and at least one open position, in which the valve element is moved from the axial abutting point in an axial actuating direction (A); and a spring, the spring comprising a coil spring, that is supported on the valve element and is configured to cause a displacement of the valve element into the closed position;

wherein the supporting point of the spring on the valve element axially protrudes past the abutting point opposite to the axial actuating direction (A) in the closed position of the valve element.

9. The device according to claim 8, wherein the valve element has a guide pin, which extends from the supporting point in the actuating direction (A) and over which the spring is placed, wherein the guide pin particularly moves out of a housing that defines the device during the displacement of the valve element in the actuating direction (A) whereas the spring is supported on a housing wall lying opposite of the supporting point, and further wherein a passage opening for the guide pin in the housing particularly is dimensioned in such a way that it guides the valve element during a displacement in the actuating direction and in the closing direction (S).

10. The device according to claim 9, wherein the spring has a progressive spring characteristic and comprises a progressively coiled spring, wherein another spring is arranged in series with this spring, and the upstream spring near the valve element particularly has a lower spring constant than the downstream spring, and wherein the spring near the valve element particularly is supported on the valve element and the downstream spring is supported on the spring near the valve element.

11. The device according to claim 8, further comprising a multipart housing, wherein the housing particularly has an inflow housing part that contains the flow passage opening and a cover part that can be connected to the inflow housing part, and wherein the valve element and the spring particularly are supported in the housing or wherein the housing parts are connected to one another by means of a clip connection and/or wherein the housing, particularly the inflow housing part, can be connected to the crankcase by means of a tongue-and-groove connection.

12. The device according to claim 11, wherein the valve element has a rotationally symmetrical bowl upstream of the gas flow, wherein the supporting point for the spring is formed on the bowl base of the bowl.

13. The device according to claim 8, wherein the valve seat and the valve element are realized in a collar-shaped manner and particularly can be telescopically displaced inside one another in such a way that a continuous collar-shaped gap is formed in the circumferential direction (U) between the valve element and the valve seat in the open position or in the closed position.

14. The device according to claim 8, further comprising at least one separating nozzle, which has a constant through-flow cross section, is arranged downstream of the valve element for the nebulization and/or defined discharge of the gas flow, wherein a flow cross section between the valve element and the valve seat at the abutting point lies in the range between 90% and 200%, of a through-flow cross section of the separating nozzle in an open position.

15. A particle separator with at least two devices for separating particles from a gas flow, from a blow-by gas of a crankcase ventilation in an internal combustion engine, wherein the at least two devices respectively comprise:

a valve seat that defines a flow passage opening; and a movable valve element;

wherein the at least two devices particularly are fluidically connected to one another in such a way that a gas flow can be divided between the two devices upstream of the particle separator and a gas flow can flow from one device into the other device.

16. A crankcase ventilation system of an internal combustion engine comprising:

a crankcase with a flow outlet opening, through which blow-by gas can exit the crankcase; and a device for separating particles from the blow-by gas, which is fluidically connected to the flow outlet opening and further comprises:

a valve seat that defines a flow passage opening; and a valve element that can be displaced between a closed position, in which the valve element is in abutting contact with the valve seat and the abutting contact defines an axial abutting point, and at least one open position, in which the valve element is moved from the axial abutting point in an axial actuating direction (A), wherein the valve element has a rotationally symmetrical bowl upstream of the gas flow;

wherein a base of the bowl axially protrudes past the abutting point opposite to the axial actuating direction (A) by at least 10% of the longitudinal extent of the valve element.

* * * * *